United States Patent [19]

Tomaro

[11] 4,327,278

[45] Apr. 27, 1982

[54] SIMPLIFIED MULTIPLE SPEED HAIR DRYER

[75] Inventor: John W. Tomaro, Maplewood, N.J.

[73] Assignee: Conair Corporation, Edison, N.J.

[21] Appl. No.: 74,389

[22] Filed: Sep. 10, 1979

[51] Int. Cl.[3] ..... A45D 20/10; H05B 1/02

[52] U.S. Cl. ..... 219/364; 219/370

[58] Field of Search ..... 219/364, 370

[56] References Cited

U.S. PATENT DOCUMENTS

| | | | |
|---|---|---|---|
| 3,358,205 | 12/1967 | Wechsler | 318/332 |
| 3,518,522 | 6/1970 | Jaffe et al. | 318/442 |
| 3,937,231 | 2/1976 | Tucker et al. | 219/370 |
| 3,947,659 | 3/1976 | Ono | 219/364 |
| 4,003,388 | 1/1977 | Nopanen | 219/364 |
| 4,085,309 | 4/1978 | Godel et al. | 219/364 |
| 4,088,869 | 5/1978 | Nopanen | 219/364 |

FOREIGN PATENT DOCUMENTS

| | | | |
|---|---|---|---|
| 2615223 | 10/1977 | Fed. Rep. of Germany | 219/364 |
| 2007877 | 5/1979 | United Kingdom | 219/364 |

*Primary Examiner*—B. A. Reynolds

*Assistant Examiner*—Bernard Roskoski

*Attorney, Agent, or Firm*—Haynes N. Johnson

[57] ABSTRACT

A simplified four heat, two speed hair dryer is provided having a housing with a plurality of heating elements mounted therein and a fan driven by a motor for blowing air over the heating elements and delivering hot air from the dryer. A source of alternating current potential is provided across a bridge rectifier motor control circuit in the housing. A dc motor which drives the fan for the dryer is coupled across the bridge rectifier circuit. A switch is coupled to one arm of the bridge rectifier circuit for switching the arm in and out of the bridge rectifier circuit. When the switch is activated, the motor is operated by a full wave rectified source which operates the motor at high speed. When the switch is open, a half wave rectified source is applied to the motor thereby operating the motor at a lower speed. This simple motor speed control circuit with a minimum number of heater elements and two other switches provides a four heat, two speed dryer without the need for incorporating additional speed control circuitry or heater elements.

2 Claims, 3 Drawing Figures

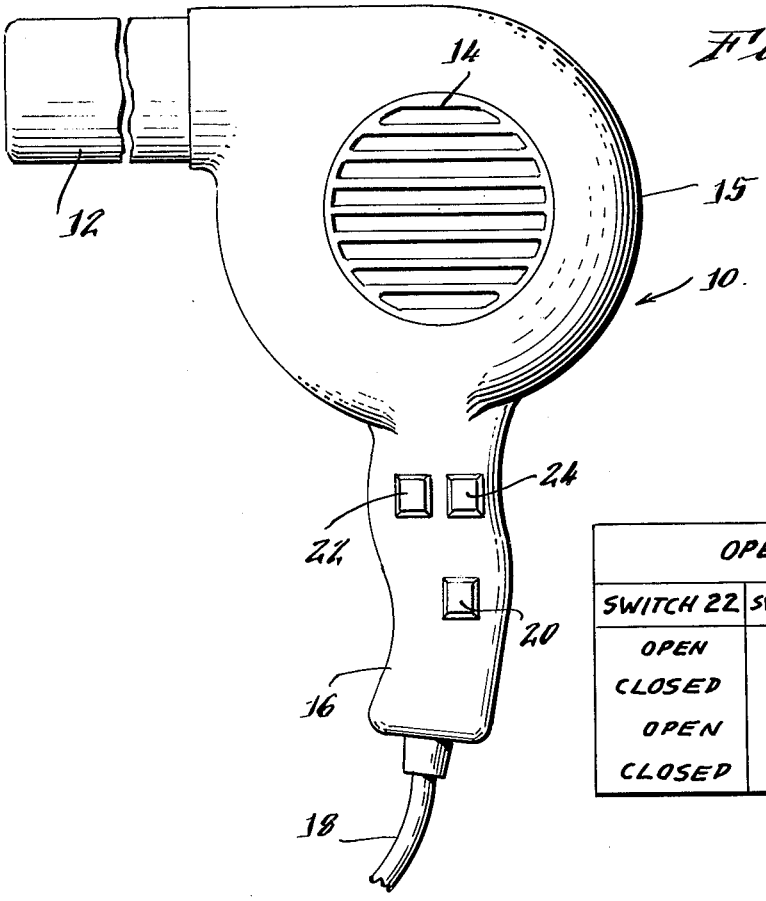
Fig. 1.
Fig. 3.
| OPERATIONAL TABLE | | | |
|---|---|---|---|
| SWITCH 22 | SWITCH 24 | FAN SPEED | HEAT LEVEL |
| OPEN | OPEN | LOW | COOL |
| CLOSED | OPEN | LOW | WARM |
| OPEN | CLOSED | HIGH | HOT |
| CLOSED | CLOSED | HIGH | VERY HOT |
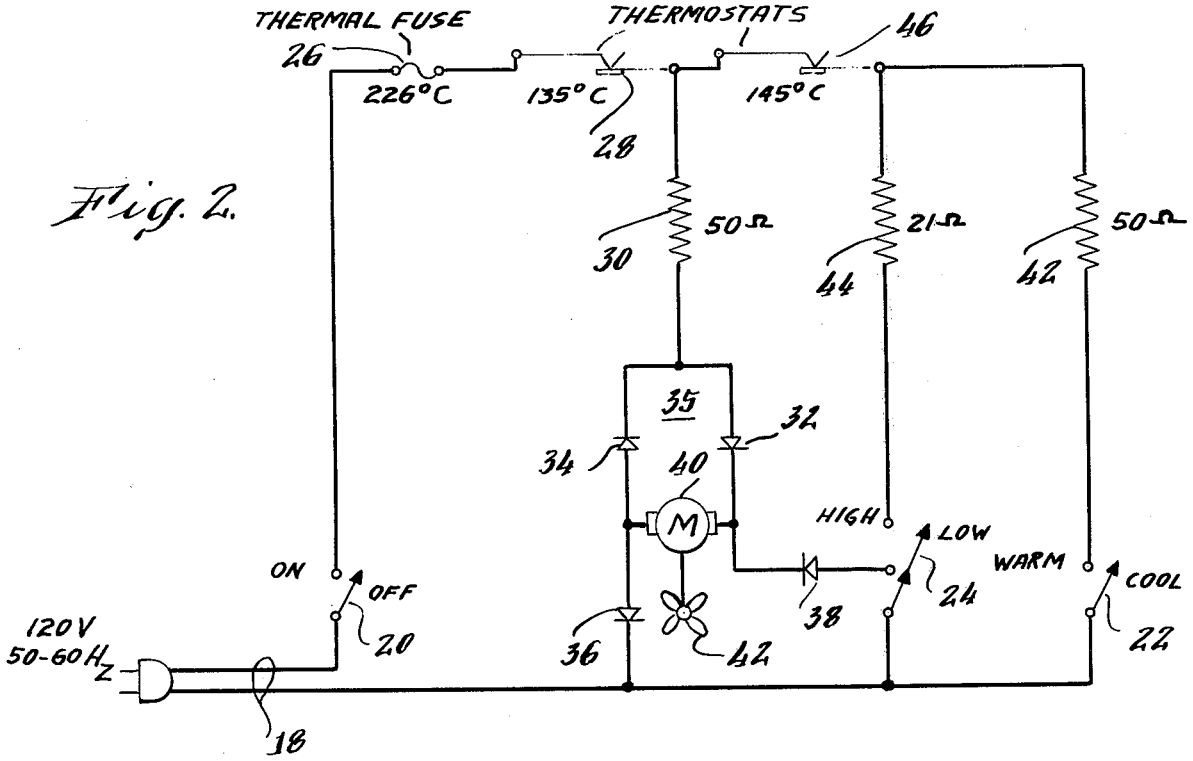
Fig. 2.

SIMPLIFIED MULTIPLE SPEED HAIR DRYER

BACKGROUND OF THE INVENTION

This invention relates to a hair dryer appliance and more particularly to such an appliance which has incorporated therein a simple multiple speed control circuit for providing a four heat, two speed hair dryer.

Many conventional hair dryers provide different heat levels and generally contain a blower or fan which dispenses the heated air from a nozzle on the dryer as directed by the user. Either a variable heater element or a plurality of separate heater elements are provided to obtain different heat levels. Furthermore, in order to provide multiple speeds for the fan, separate motor control circuits are included which may be in the form of speed control potentiometers.

For example, in U.S. Pat. No. Re. 19,724 separate heater, vapor generator and motor control devices are employed which may be selectively switched into the dryer electrical circuit. The motor control circuit includes a rheostat for varying the speed of the motor. Similarly, in U.S. Pat. No. 4,013,083 a potentiometer is employed in series with a motor for controlling its speed and a potentiometer is also connected in series with a heating coil for varying the heat level thereof.

Any additional elements in the circuitry increase the complexity of the dryer, may tend to reduce its reliability as well as its operating life, may increase the size of the dryer and probably most importantly will increase the cost of manufacture and accordingly, the cost to the user.

SUMMARY

Accordingly, it is an object of this invention to provide a new and novel hair dryer which provides four heat levels and two speeds with a minimum number of heater elements in a very simple reliable circuit.

A further object of this invention is to provide a two speed hair dryer with an extremely simple motor control circuit which is inexpensive and reliable.

Still a further object of this invention is to provide a new and improved multiple heat level, two speed dryer having a simple motor control circuit which is incorporated in circuit with one of the heater elements.

In carrying out this invention in one illustrative embodiment thereof, a multiple speed hair dryer is provided having a housing with a plurality of heater elements mounted therein and a fan driven by a motor for blowing air over the heating elements and delivering hot air from the housing. A source of alternating current potential is applied across a bridge rectifier circuit having a switch coupled in one arm thereof for switching the arm in and out of the bridge. A dc motor which operates the fan of the dryer is connected across the bridge rectifier circuit which operates at high speed when the switch is actuated thereby applying full wave rectified power to the motor and which operates at a lower speed when the switch is open such that half wave rectified power is applied to the dc motor.

In a further aspect thereof, three heater elements are connected in parallel across a source one of which is coupled in series with the bridge rectifier circuit. By providing suitable switching, four heat levels and two speeds are obtained using only three heater elements while eliminating the need for a separate motor control circuit.

BRIEF DESCRIPTION OF THE DRAWINGS

The invention, together wih further objects, aspects and advantages thereof, will be better understood from the following description taken in connection with the accompanying drawings.

FIG. 1 is a plan side elevational view illustrating one form of housing which may be utilized for the hair dryer embodied in the present invention.

FIG. 2 is a schematic circuit diagram of the new and novel multiple heat and speed hair dryer in accordance with the present invention.

FIG. 3 is an operational table indicating fan speed and relative heat levels for various operating positions of the circuit shown in FIG. 2.

DESCRIPTION OF THE PREFERRED EMBODIMENTS

Referring now to FIG. 1, a hair dryer, referred to generally with the reference character 10, includes a housing 15 having a nozzle or barrel 12 extending therefrom, an air intake grill 14 positioned centrally therein and a handle 16 extending therefrom to which a line cord 18 is attached. The handle 16 has a plurality of paddle switches mounted thereon including an on-off switch 20, a warm-cool switch 22 and a high-low switch 24. The housing illustrated in FIG. 1 is merely an illustrative example and it will be apparent that different types, shapes and sizes of hair dryer housings may be employed.

As will be seen in FIG. 2, the line cord 18 applies a 120 volts 50–60 $H_z$ source through the on-off switch 20, a thermal fuse 26 and a thermostat 28 across a heating element 30 and a serially connected bridge rectifier circuit 35. The bridge rectifier circuit 35 is comprised of unidirectional conducting devices 32, 34, 36 and 38. The arm of the bridge rectifier circuit 35 which includes unidirectional conducting device 38, is coupled through high-low switch 24 to the return path for the line cord 18. Accordingly, unidirectional conducting device 38 may be switched in and out of the full wave rectifier bridge 35. A dc motor 40 is connected across the bridge rectifier circuit 35 and drives a fan 42. The bridge rectifier circuit may be conveniently mounted on an end of the motor 40. A heater element 44 is coupled through a thermostat 46 and when high-low switch 24 is closed across the series circuit made up of heater element 30 and the bridge rectifier 35. Likewise, a heater element 42 is coupled in parallel across heater element 30 and bridge rectifier 35 when the arm-cool switch 22 is closed.

By way of exmaple, the heater elements 30, 44 and 42 may comprise Kanthal "D" coils spirally wound on interlocking mica sheets having a cold resistance of the magnitude indicated on FIG. 2. The dc motor 40 may have an operating voltage of 25 volts dc with a loaded speed of 19,000 rpm and a loaded current of 1.35 amps.

In operation when the on-off switch 20 is actuated to the "on" position with switches 22 and 24 unactuated or open, power is applied across the heating element 30 and the bridge rectifier circuit 35. Accordingly, heating element 30 is actuated and half wave rectified power is applied to the motor 40 through unidirectional conducting devices 32 and 36. The motor 40 is accordingly run at low speed and one heat level is provided which is referred to as "cool". When switch 22 is actuated or closed, heating element 42 is placed across the source in parallel with the heating element 30 and the motor 40 is still being actuated by half wave rectified output from the bridge circuit 35. This represents operation at low speed at a "warm" heat level. By opening switch 22 and closing switch 24, heater elements 30 and 44 are connected across the source and at the same time the arm of the bridge rectifier 35 containing unidirectional conducting device 38 is closed thereby providing full wave rectification to the motor and heater element 30 and driving the motor and its associated fan 42 at high speeds. This combination produces a "hot heat" level with the fan running at high speed. When switches 22 and 24 are both closed, all three heating elements 30, 44 and 42 are connected across the source in parallel producing a "very hot" or the maximum heat level for the hair dryer with the bridge rectifier circuit being closed thereby providing full wave power to the motor 40 and driving the fan 42 at high speed. The operational table shown in FIG. 3 outlines the above operation indicating the fan speed and heat levels for various positions of the switches 22 and 24.

In accordance with the operation just described a four heat, two speed hair dryer is provided which utilizes a minimum number of heating elements. Four heat levels are achieved while utilizing only three heating elements. This is possible due to the fact that the heater element 30 is connected in series with the motor control circuit. Accordingly, heater element 30 not only provides heat but limits current applied to the motor 40 thus performing a dual function. In combination with the bridge rectifier circuit which has one arm which may be switched in and out of the bridge, two speeds are conveniently provided without the necessity of providing additional elements or a separate motor control circuit for providing the change in speeds.

By way of example, using the heating elements shown for purposes of illustration, the four heat levels provided are cool: 110 watts, warm: 400 watts, hot: 900 watts, and very hot: 1,200 watts.

Since other changes and modifications varied to fit particular operating requirements and environments will be apparent to those skilled in the art, the invention is not considered limited to the examples chosen for purposes of illustration, and covers all changes and modifications which do not constitute a departure from the true spirit and scope of this invention.

What is claimed is:

1. A two speed, multiple heat hair dryer comprising:

means for coupling said hair dryer to a source of potential, first and second heater elements, a bridge rectifier circuit, a d.c. motor connected across said bridge rectifier circuit, first switch means connected to an arm of said bridge rectifier circuit for switching said arm into and out of said bridge rectifier circuit, means for coupling said first heater element and said bridge rectifier circuit in series across said source of potential, said d.c. motor being driven at a first speed when said first switch mmeans is open and at a second higher speed when said first switch means is closed, said second heater element being electrically connected to said first switch means for simultaneously electrically coupling said second heater element in parallel to said first heater element across said source of potential through said first switch means when said arm of said bridge rectifier circuit is switched into said bridge rectifier circuit, a third heater element and second switch means for selectively electrically coupling said third heater element across said source of potential through said second switch means, said first heater element providing a first heat level when said first and second switch means are open, said first and second heater elements providing a second heat level when said first switch means is closed, and said second switch means is open, said first and third heater elements providing a third heat level when said second switch means is closed and said first switch means is open, and said first, second and third heater elements providing a fourth heat level when said first and second switch means are closed.

2. In a multiple speed hair dryer having a housing with a plurality of heater elements mounted therein and a fan driven by a motor for flowing air over the heating elements and delivering hot air from said housing, the improvement comprising:

a bridge rectifier circuit, means for coupling a source of alternating current potential across said bridge rectifier circuit, a first switch coupled to one arm of said bridge rectifier circuit for switching said arm in and out of said bridge rectifier circuit, a d.c. motor coupled across said bridge rectifier circuit, said motor operating at a higher speed when said first switch is closed than when said first switch is open, thereby providing two operating speeds for said hair dryer, a first heater element connected in series with said bridge rectifier circuit across said source of potential for providing one heat level for said hair dryer and limiting the current applied to said motor, a second heater element electrically connected to said first switch, said second heater element being simultaneously electrically coupled in parallel to said first heater element across said source of potential through said first switch when said arm of said bridge rectifier circuit is switched into said bridge rectifier circuit, a third heater element and a second switch, said third heater element being electrically coupled across said source of potential when said second switch is closed, whereby said hair dryer is capable of providing two motor speeds and four heating levels by manipulation of said first and second switches.

* * * * *